US007164093B2

(12) United States Patent
Kurek

(10) Patent No.: US 7,164,093 B2
(45) Date of Patent: Jan. 16, 2007

(54) MOTOR STARTING SWITCH

(75) Inventor: Stephen R. Kurek, Rego Park, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/326,688

(22) Filed: Jan. 6, 2006

(65) Prior Publication Data

US 2006/0180458 A1 Aug. 17, 2006

Related U.S. Application Data

(60) Provisional application No. 60/648,793, filed on Jan. 31, 2005.

(51) Int. Cl.
*H01H 21/00* (2006.01)

(52) U.S. Cl. ..... 200/558; 200/557; 200/559

(58) Field of Classification Search ..... 200/6 R–6 C, 200/16 R–16 D, 553, 557–561, 339, 61.54–61.57; 280/731, 728.2; 74/552
See application file for complete search history.

(56) References Cited

U.S. PATENT DOCUMENTS

| | | | | | |
|---|---|---|---|---|---|
| 2,901,581 | A | * | 8/1959 | Russell | 200/558 |
| 3,206,990 | A | * | 9/1965 | Uhl | 200/434 |
| 3,852,552 | A | * | 12/1974 | Kimijima et al. | 200/557 |
| 4,107,499 | A | * | 8/1978 | Weidler | 200/558 |
| 4,983,960 | A | * | 1/1991 | Dunn | 200/283 |
| 5,473,130 | A | * | 12/1995 | Pudims | 200/559 |
| 5,906,272 | A | * | 5/1999 | Kurek | 200/559 |

* cited by examiner

*Primary Examiner*—Michael A. Friedhofer
(74) *Attorney, Agent, or Firm*—Paul J. Sutton

(57) ABSTRACT

An electrical switch is disclosed having improved operational characteristics wherein when a operating handle is rotated from an OFF position to an ON position the switch provides slow motion which accelerates as the operating handle is rotated to a full open position and then provides rapid establishment of electrical contact. The operating handle having a cam that when rotated from the ON position to the OFF position forces a cam follower downwards. As a result, a bridge having coil springs connected to the cam follower is forced downwards to separate at least one electrical contact placed in proximity to the bridge.

2 Claims, 5 Drawing Sheets

FIG. 4
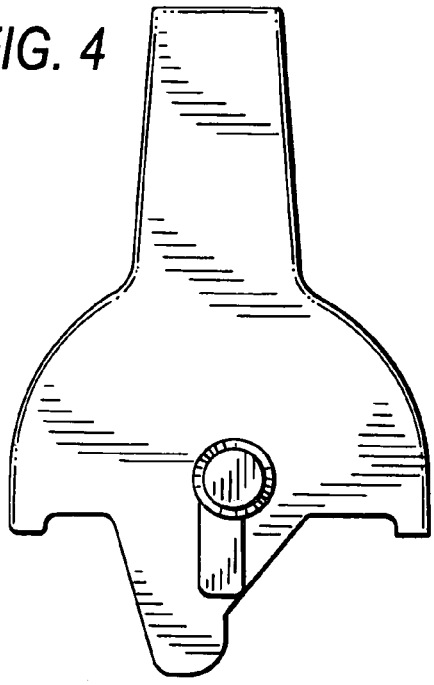
FIG. 5
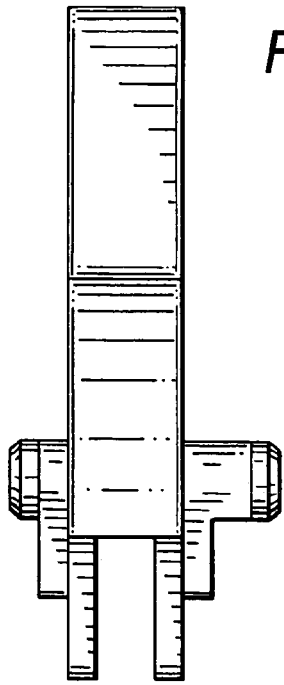
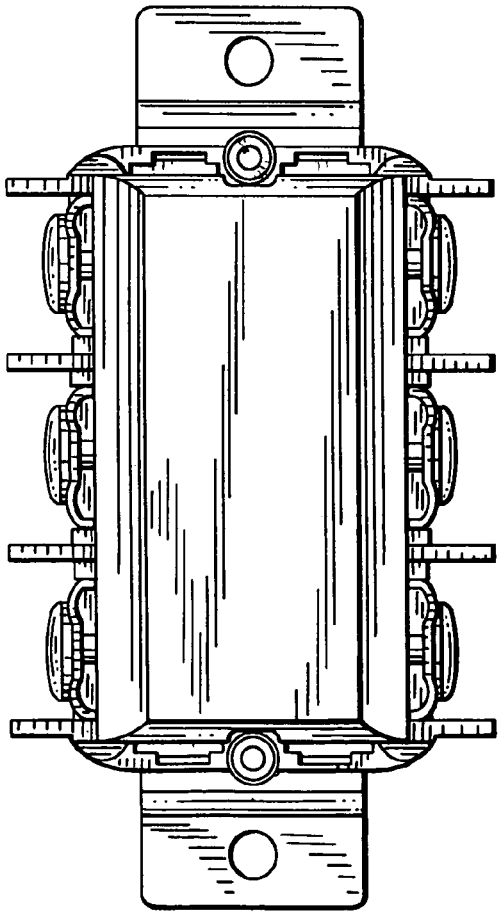
FIG. 7

MOTOR STARTING SWITCH

Under 35 CFR 119(e), this application claims the benefit of the filing date of a provisional application having Ser. No. 60/648,793 which was filed on Jan. 31, 2005.

This application includes material which is subject to copyright protection. The copyright owner has no objection to the facsimile reproduction of the patent disclosure, as it appears in the Patent and Trademark Office files or records, but otherwise reserves all rights.

FIELD OF THE INVENTION

The present invention relates to the field of electrical switches. More specifically, this invention relates to switches for use in alternating currents.

BACKGROUND OF THE INVENTION

Lever actuated switches are common in the art and are used to provide a means to conveniently and affirmatively switch electrical current. Many variations of switches exist that utilize a lever which acts upon a plunger or similar structure to engage or disengage electrical contacts and thereby establish or terminate electrical service to one or more loads. An example of a patented switch of this type is disclosed in U.S. Pat. No. 4,400,603. This patent discloses a switch for use in alternating current (AC) circuits wherein a pivotally mounted operating handle accepts a pivot pin at one end of a link member. A pivot pin at the other end of the link member fits into a brush lifter. Angular motion of the operating handle produces a rectilinear motion in the brush lifter which results in opening and closing of the switch contacts. An arc shield disposed within the switch encircles one out of each pair of contacts, and protects the switch mechanism from destructive effects of contact arcing.

A need exists for an improved switch that incorporates a reduced number of moving parts. This improved switch should be enabled to be produced at reduced cost. Furthermore, this switch should provides improved operational characteristics.

The present invention is directed to overcoming, or at least reducing the effects of one or more of the problems set forth above.

SUMMARY OF THE INVENTION

To address the above-discussed deficiencies of electrical switches, the present invention teaches an electrical switch that provides enhanced operational characteristics wherein the rotary motion of an operating handle is translated into a linear motion through the incorporation of a cam follower. Unique geometry of a cam operating upon the cam follower translates into a switching action which provides for an initial slow break that accelerates as the operating handle is rotated to a full open position. The cam follower then rapidly establishes contact and minimizes arcing when the switch is closed.

In particular, the operating handle having a cam is in cooperative alignment with a cam follower such that when the operating handle is rotated from an OFF position to an ON position, the cam causes the cam follower to move a bridge having coil spring into contact with at least one electrical contact. In the alternative, when the operating handle is rotated from the ON position to the OFF position, the cam causes the cam follower to separate the bridge apart from the electrical contact.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 4 is a side view of operating handle 10;

FIG. 5 is an end view of operating handle 10;

FIG. 7 is a plan view of the bottom of the switch 100 of FIG. 1;

DETAILED DESCRIPTION OF PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
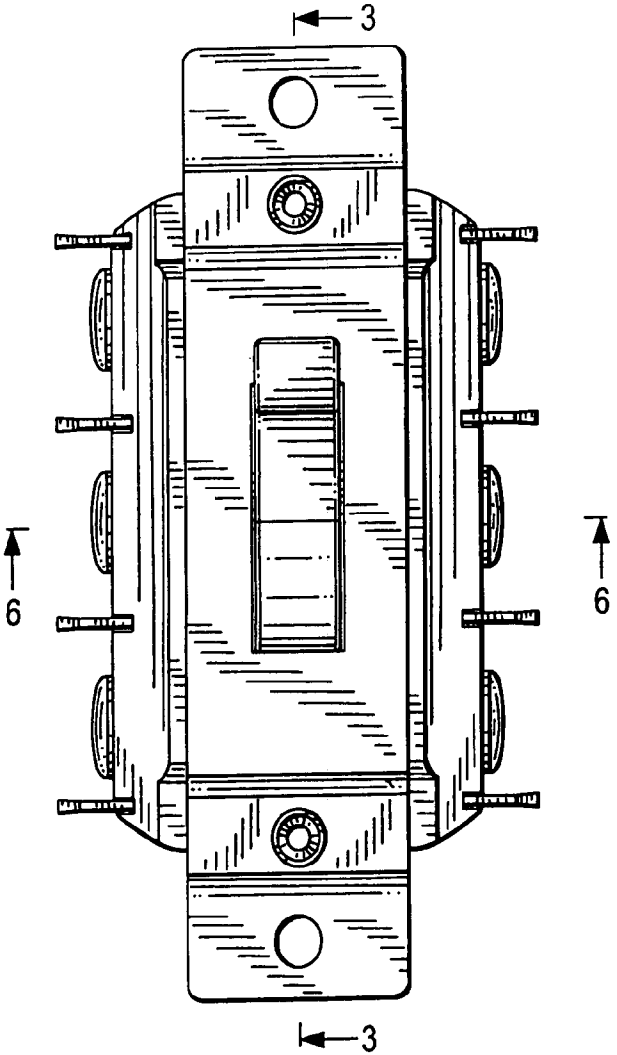
FIG. 1 illustrates the top view of a three-pole switch in accordance with the present invention with the operating handle 10 in the ON position.

The present invention relates to a switch having improved operational characteristics, with relatively fewer parts. Referring to the drawings, FIG. 1 illustrates the top view of a three-pole switch in accordance with the present invention with the operating handle 10 in the ON position. The switch enclosure 12, such as of molded insulating material, is large enough to contain three poles. However, it will be understood that the invention applies as well to switches of less or greater complexity which contain a different number of poles. The cover arrangement includes switch enclosure 12 and faceplate 14. Faceplate 14, such as of metal, is mounted to enclosure 12 by two faceplate bolts, 24 and 26. These faceplate bolts, 24 and 26, serves to hold operating handle pivot pin 40 (shown in FIG. 3) on operating handle 10 in slots (not shown) of enclosure 12. Mounting holes 22 and 28 are provided in face plate 14, for mounting the switch on a control panel. Six conductor clamp bolts 16, 18, 20, 30, 32, and 34 are shown to accommodate the three poles of the switch shown in this embodiment.

Figure 2:
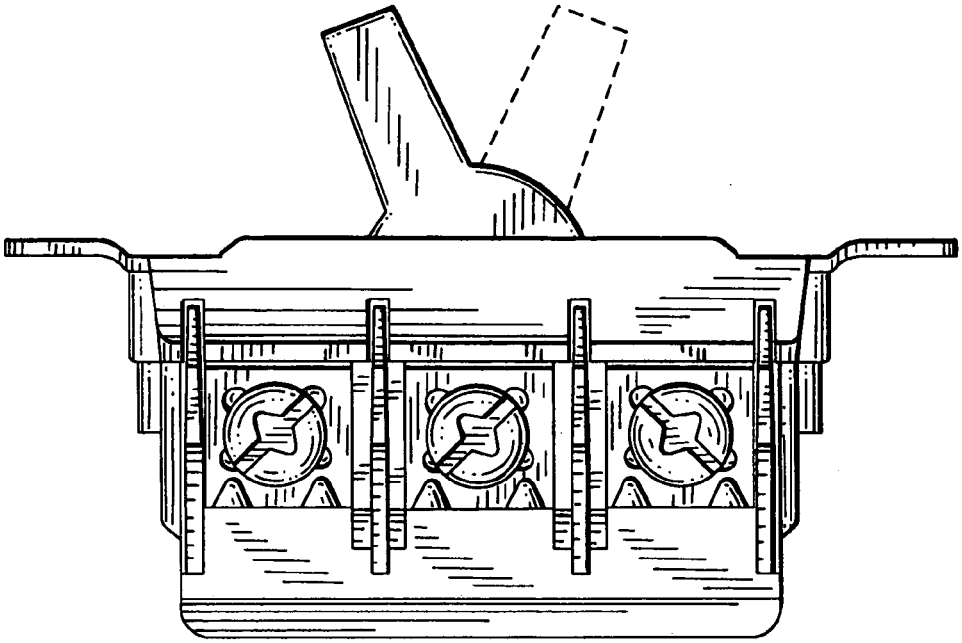
FIG. 2 displays a side elevation view of the switch 100 of FIG. 1.

FIG. 2 is a side elevation view of the switch of FIG. 1, showing conductor clamp bolts 30, 32, and 34 for a circuit which will be controlled by the switch. A like number of conductors, 16, 18 and 20, shown in FIG. 1 is provided on the opposite side of the switch (not shown in FIG. 2). Referring back to FIG. 2, this first embodiment of the present invention comprises a base 36 and a cover arrangement including switch enclosure 12 and faceplate 14. The switch enclosure 12 and faceplate 14 are held together by faceplate bolts 24 and 26 (shown in FIG. 1).

Figure 3:
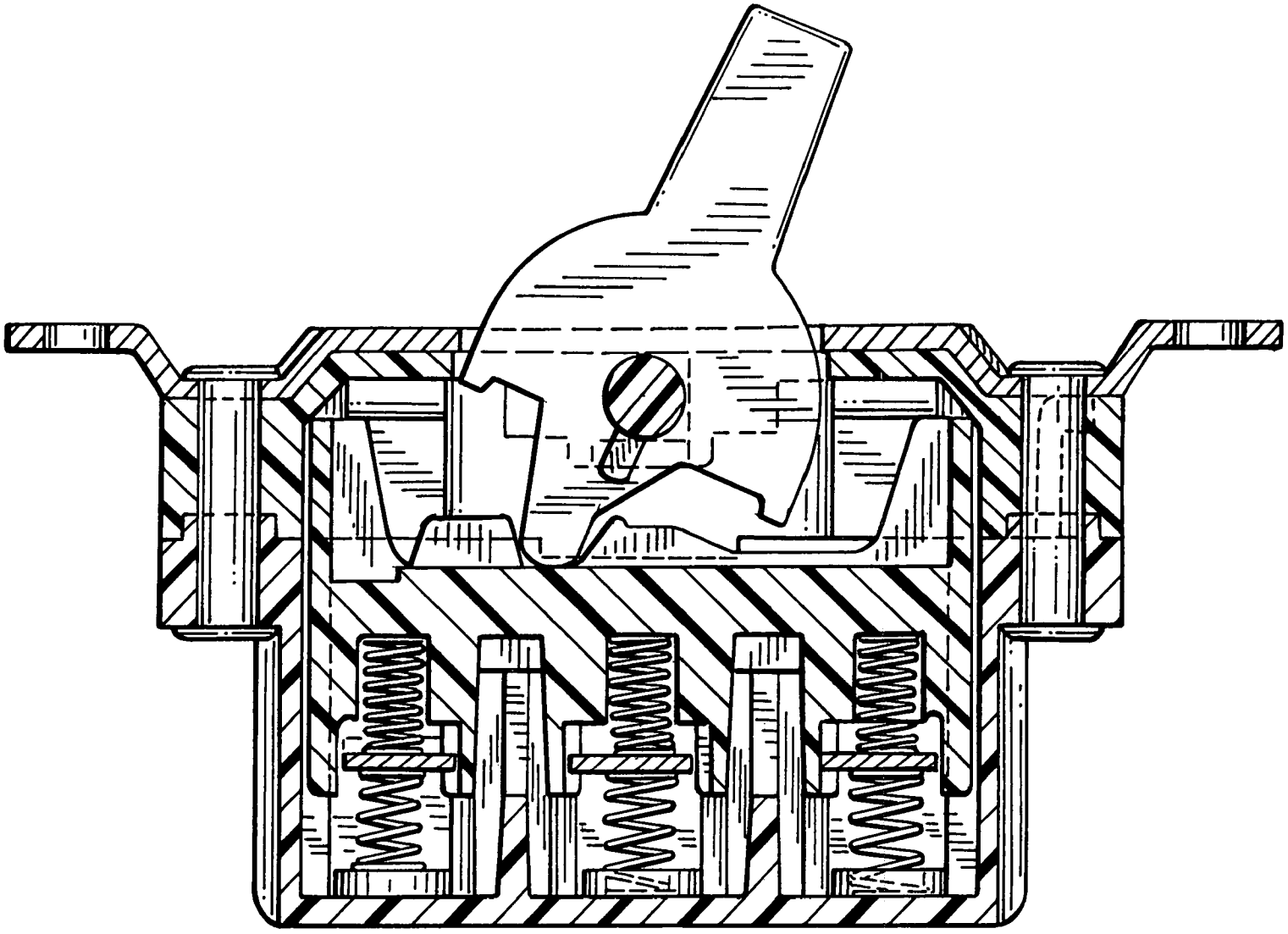
FIG. 3 illustrates a cross-sectional view of switch 100 of FIG. 1 taken along Section line 3—3 where the cut extends through switch 100.

FIG. 3 depicts a cross-sectional view of switch 100 of FIG. 1 taken along Section line 3—3 where the cut extends through switch 100 revealing coil springs 52–66, cam 80 of operating handle 10, and cam follower 50. As can be seen from FIG. 3, cam 80 is integrated into operating handle 10 such that when operating handle 10 is rotated, cam 80 acts upon cam follower 50 which engages bridges 82–86 which is part of a contact making and contact breaking mechanism. The action of cam follower 50 upon bridges 82–86 causes a downward motion of bridges 82–86 resulting in contact opening and placing operating handle 10 in a locked position.

During the actuation of operating handle 10 to its locked position, the resultant downward movement of bridges 82–86 compresses coil springs 52–62 which remain compressed as long as operating handle 10 remains in the locked position. When the position of operating handle 10 is reversed (moved out of locked position), coil springs 52–62 expand and bring bridges 82, 84, and 86 in contact with respective conductors, 16, 18, 20 and, thereby establishing full contact position. These same bridges 82, 84, and 86 make contact with a like number of respective conductors, 30, 32, and 34, shown in FIG. 1 is provided on the opposite side of the switch (not shown in FIG. 3). Auxiliary springs 64 and 66 located inside cam follower 50 bias follower 50 to its maximum upward position thereby separating bridge 82–86 from cam follower 50 and creating an over-travel position for operating handle 10.

FIG. 4 is a side view of operating handle 10, which shows how operating handle pivot pin 40 sits off center with respect to center line A—A. Operating handle stops 82 and 84 are also shown.

FIG. 5 is an end view of operating handle 10, showing how operating handle pivot pin 40 extends from both sides of the operating handle 10. Operating handle stops 86 and 88 are also shown positioned opposite operating handle stops 82 and 84.

Figure 6:
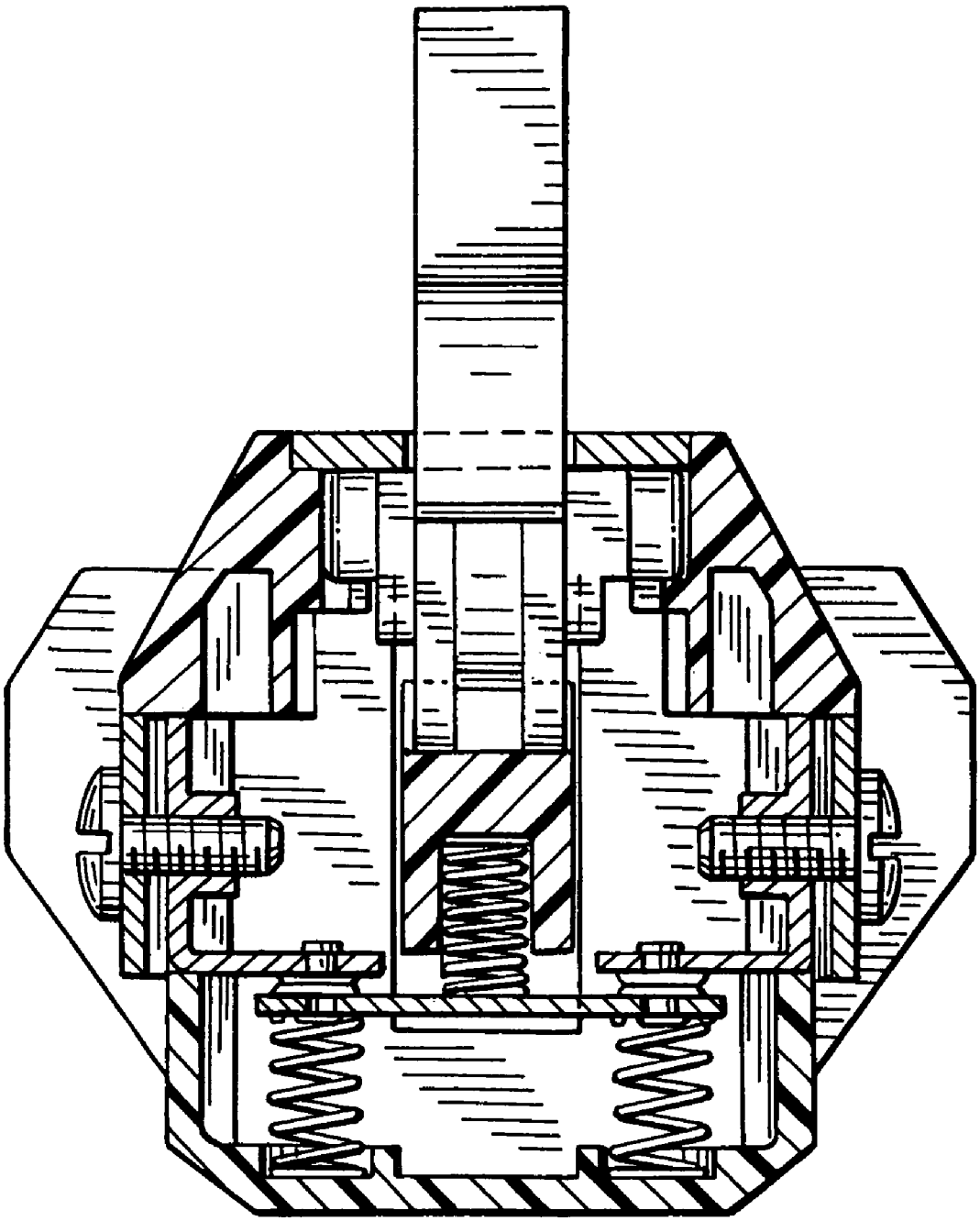
FIG. 6 depicts a cross-sectional view of switch 100 of FIG. 1 taken along Section line 6—6 where the cut extends through switch 100.

FIG. 6 depicts a cross-sectional view of switch 100 of FIG. 1 taken along Section line 6—6 where the cut extends through switch 100 revealing bridge 84 in contact with coil springs 56, 58, and 68. Bridge 84 includes contacts 70*a* and 70*c* for making contact with another pair of contacts 70*b* and 70*d*. Specifically, in operation, when cam 80 of operating handle 10 is rotated to the OFF position, cam follower 50 compresses coil spring 56 which forces bridge 84 downward. The downward motion of bridge 84 compresses coil springs 58 and 68. Contacts 70*a* and 70*c* separate from contacts 70*b* and 70*d* breaking connection with the circuits derived by conductors 32 and arm 98, on one side, and conductor 18 and arm 99, on the opposite side.

Accordingly, in operation, when cam 80 of operating handle 10 is rotated to the ON position, cam follower 50 is no longer held in the locked OFF position and is forced upwards by coil springs 56, 58 and 68. Bridge 84 is forced upwards by coil springs 58 and 68 such that contacts 70*a* and 70*c* meet respective contacts 70*b* and 70*d*. The connection through contacts 70*a* and 70*b* enables current to flow through arm 98 to conductor 32 and into the circuit being controlled by switch 100. In the same like fashion, the connection through contacts 70*c* and 70*d* enables current to flow through arm 99 to conductor 18 and into the circuit being controlled by switch 100 when handle 10 is rotated to the ON position.

FIG. 7 is a plan view of the bottom of the switch 100 of FIG. 1, showing faceplate bolts 24 and 26. Six conductor clamp bolts 16, 18, 20, 30, 32, and 34 are shown to accommodate the three poles of the switch shown in this embodiment. As earlier referenced, mounting holes 22 and 28 are provided in face plate 14, for mounting the switch on a control panel, wherein face plate 14 extends beyond either end of base 36.

Figure 8:
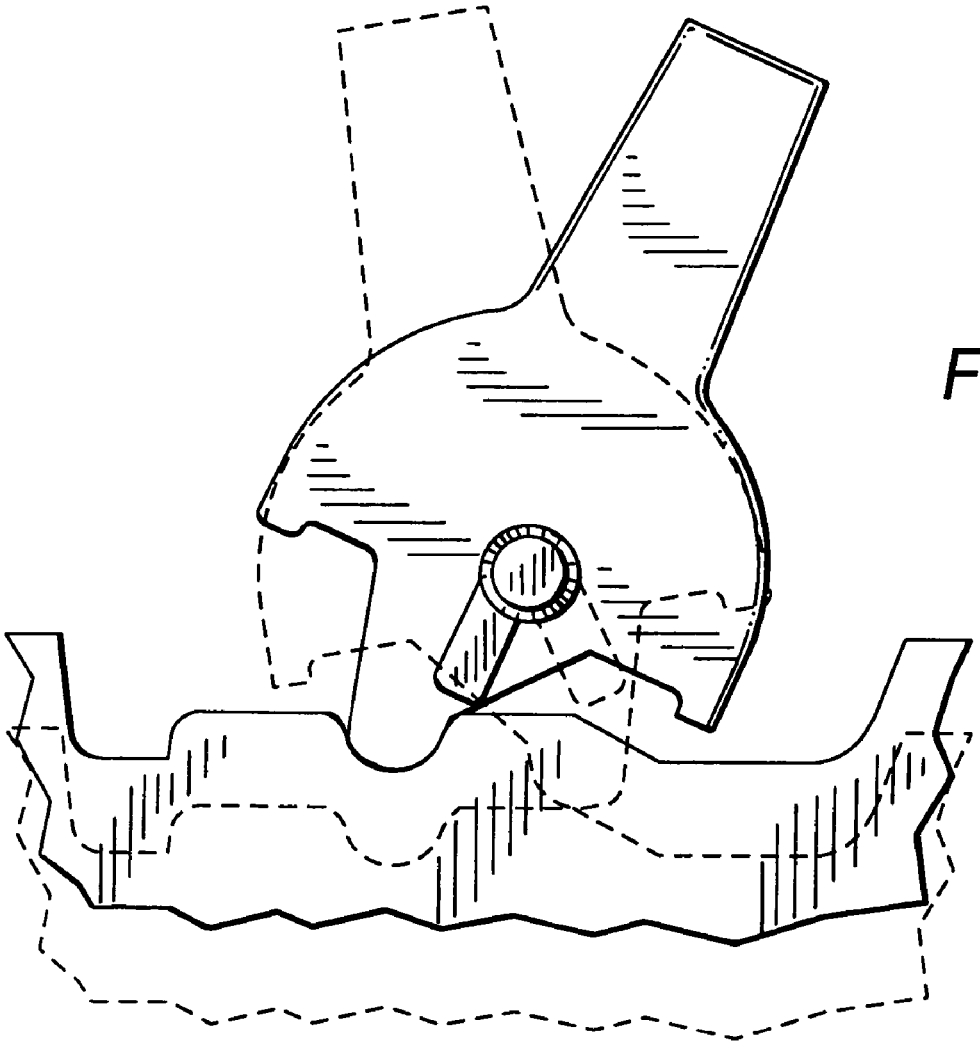
FIG. 8 illustrates operating handle 10, cam 80 and cam follower 50 in two positions to demonstrate the switch position feature.

FIG. 8 illustrates the switch position feature. When operating handle 10 pivots around pivot pin 40, from position A to position B, cam follower 50 moves from position C to position D. Specifically, operating handle stops 82 and 84 of cam 80 ride along the ridged surface of cam follower 50 when operating handle 10 pivots around pivot pin 40. The unique ridged surface of cam follower 50 ensures that operating handle 10 can only stop in the full ON or full OFF position. In the ON position, operating handle 10 is in position A. Referring back to FIG. 6, cam follower 50 is no longer held in the locked OFF position and is forced upwards by coil springs 56, 58 and 68. In the OFF position, operating handle 10 is in position B. Accordingly, referring to FIG. 6, cam 80 forces cam follower 50 to compress coil spring 56 which forces bridge 84 downward.

Figure 9:
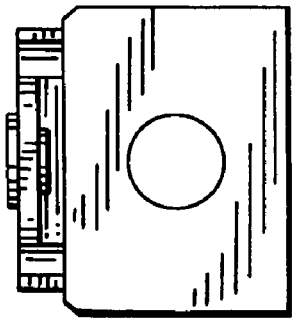
FIG. 9 shows the placement of insulating arc shield 90.

FIG. 9 shows the placement of insulating arc shield 90 around any of the stationary conductor clamp bolts 16, 18, 20, 30, 32, and 34 shown in FIGS. 1–7. By completely encircling stationary contact 16, for example, the arc shield 90 provides maximum protection for structures in the vicinity of stationary contact 16. In this embodiment, arc shield 90 is held in place by virtue of the fact that the edge 96 of the arc shield 90 fits in a gap between enclosure component 12 and base 36, as shown in FIG. 2.

While the invention has been described in detail and with reference to a specific embodiment thereof, it will be apparent to those skilled in the art that various changes and modifications can be made therein without departing from the spirit and scope thereof. For example switch 100 can be manufactured as a two pole or three pole device respectively. Thus, it is intended that the present invention cover the modifications and variations of this invention provided they come within the scope of the appended claims and their equivalents.

Advantages of this design include but are not limited to an electrical switch having a high performance, simple, and cost effective design.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. An electrical switch comprising:

an operating handle, the operating handle further comprising a cam;

a cam follower, the cam follower in cooperative alignment with the cam wherein movement of the cam causes cooperative movement of the cam follower;

a bridge coupled to the cam follower, the bridge having coil springs attached thereto; and at least one electrical contact placed in proximity to the bridge whereby a range of motion of the bridge brings the bridge into physical contact with the electrical contact and wherein when the operating handle is rotated from an OFF position to an ON position the cam causes the cam follower to move the bridge into contact with the electrical contact;

wherein the operating handle is provided with stops and the cam follower having a ridged surface such that the stops and the ridged surface limit the pivot angle of the operating handle in the ON and OFF positions.

2. An electrical switch comprising:

an operating handle, the operating handle further comprising a cam;

a cam follower, the cam follower in cooperative alignment with the cam wherein movement of the cam causes cooperative movement of the cam follower;

a bridge coupled to the cam follower, the bridge having coil springs attached thereto;

at least one electrical contact placed in proximity to the bridge whereby a range of motion of the bridge brings the bridge into physical contact with the electrical contact and wherein when the operating handle is rotated from an OFF position to an ON position the cam causes the cam follower to move the bridge into contact with the electrical contact; and an insulating arc shield having an aperture, wherein the at least one electrical contact is seated in the aperture of the insulating we shield.

* * * * *